US007457344B2

(12) United States Patent
Fishman et al.

(10) Patent No.: US 7,457,344 B2
(45) Date of Patent: Nov. 25, 2008

(54) ELECTRIC INDUCTION CONTROL SYSTEM

(75) Inventors: Oleg S. Fishman, Maple Glen, PA (US); Mike Maochang Cao, Westampton, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 11/297,010

(22) Filed: Dec. 8, 2005

(65) Prior Publication Data

US 2006/0118549 A1 Jun. 8, 2006

Related U.S. Application Data

(60) Provisional application No. 60/634,353, filed on Dec. 8, 2004.

(51) Int. Cl.
*H05B 6/06* (2006.01)

(52) U.S. Cl. ..... 373/150; 373/151; 373/147

(58) Field of Classification Search ..... 373/150, 373/151, 138, 139, 144–152, 154; 75/10.14, 75/10.15; 219/626, 620, 625, 627, 650; 307/11, 307/17, 31; 363/14, 75, 64, 91
See application file for complete search history.

(56) References Cited

U.S. PATENT DOCUMENTS 5,682,304 A * 10/1997 Shteynberg ..... 363/75
5,968,398 A * 10/1999 Schmitt et al. ..... 219/626
6,542,535 B2 * 4/2003 Fishman et al. ..... 373/150
6,696,770 B2 * 2/2004 Nadot et al. ..... 307/17

* cited by examiner

*Primary Examiner*—Quang T Van
(74) *Attorney, Agent, or Firm*—Philip O. Post

(57) ABSTRACT

An apparatus and process are provided for controlling the heating or melting of an electrically conductive material. Power is selectively directed between coil sections surrounding different zones of the material by changing the output frequency of the power supply to the coil sections. Coil sections include at least one active coil section, which is connected to the output of the power supply, and at least one passive coil section, which is not connected to the power supply, but is connected in parallel with a tuning capacitor so that the at least one passive coil section operates at a resonant frequency and the output frequency of the power supply is changed so that the induced power in the at least one passive coil section changes as the frequency is changed.

7 Claims, 14 Drawing Sheets

– –PRIMARY SECTION POWER
· · ·SECONDARY SECTION POWER
—TOTAL COIL POWER

ELECTRIC INDUCTION CONTROL SYSTEM

CROSS REFERENCE TO RELATED APPLICATIONS

This application claims the benefit of U.S. Provisional Application No. 60/634,353, filed Dec. 8, 2004, hereby incorporated by reference in its entirety.

FIELD OF THE INVENTION

The present invention relates to control of electric induction heating or melting of an electrically conductive material wherein zone heating or melting is selectively controlled.

BACKGROUND OF THE INVENTION

Batch electric induction heating and melting of an electrical conductive material can be accomplished in a crucible by surrounding the crucible with an induction coil. A batch of an electrically conductively material, such as metal ingots or scrap, is placed in the crucible. One or more induction coils surround the crucible. A suitable power supply provides ac current to the coils, thereby generating a magnetic field around the coils. The field is directed inward so that it magnetically couples with the material in the crucible, which induces eddy current in the material. Basically the magnetically coupled circuit is commonly described as a transformer circuit wherein the one or more induction coils represent the primary winding, and the magnetically coupled material in the crucible represents a shorted secondary winding.

FIG. 1 illustrates in simplified form one example of a circuit comprising a power supply, load impedance matching element (tank capacitor $C_T$), and induction coil $L_L$ that can be used in a batch melting process. The power supply 102 comprises ac to dc rectifier 104 and inverter 106. Rectifier 104 rectifies available ac power (AC MAINS) into dc power. Typically after filtering of the dc power, inverter 106, utilizing suitable semiconductor switching components, outputs single-phase ac power. The ac power feeds the load circuit, which comprises the impedance of the induction coil and the impedance of the electromagnetically coupled material in the crucible, as reflected back into the primary load circuit. The value of tank capacitor $C_T$ is selected to maximize power transfer to the primarily inductive load circuit. Induction coil $L_L$ comprises primary section $L_P$ and secondary section $L_S$, which are preferably connected in a counter-wound parallel configuration to establish instantaneous current flow through the coil as indicated by the arrows in FIG. 1.

FIG. 2(*a*) illustrates the use of the arrangement in FIG. 1 with crucible 110 to batch melt generally solid metal composition 112 (diagrammatically shown as discrete circles) that is placed in the crucible. The state of the batch melting process in FIG. 2(*a*) is referred to as the "cold state" since generally none of the metal composition is melted. Load impedance for the upper (primary) coil load circuit is substantially equal to the load impedance for the lower (secondary) coil load circuit. As the metal composition is inductively heated, molten material forms at the bottom of the crucible while solid material is generally added to the upper section of the crucible. FIG. 2(*b*) illustrates the "warm state" of the batch melting process wherein the lower half of the crucible generally contains molten material (diagrammatically shown as lines) and the upper half of the crucible generally contains solid material. In the warm state the load impedance of the lower coil load circuit is lower than the load impedance of the upper coil load primarily since the equivalent load resistance of the molten material is lower than the equivalent load resistance of the solid material. Finally in FIG. 2(*c*), which illustrates the "hot state" of the batch melting process, generally all of the material in the crucible is in the molten state, and the load impedances in the upper and lower coil load circuits are equal, but lower in magnitude than the load impedances in the cold state.

FIG. 3(*a*), FIG. 3(*b*) and FIG. 3(*c*) graphically illustrate the division of power supplied from the power supply in the upper (primary section $c1_i$ in these figures) and lower (secondary section $c2_i$ in these figures) coil sections for the total coil ($c_I$ in these figures) shown in FIG. 1 and FIG. 2(*a*) through FIG. 2(*c*) as the batch melting process proceeds through the cold, warm and hot stages, respectively. For example: in the cold state (FIG. 3(*a*) with power supply output at 600 kW and approximately 390 Hertz), approximately 300 kW is supplied to the upper coil section and 300 kW is supplied to the lower coil section; in the warm state (FIG. 3(*b*) with power supply output at 600 kW and approximately 365 Hertz), approximately 200 kW is supplied to the upper coil section and 400 kW is supplied to the lower coil section; and in the hot state (FIG. 3(*c*) with power supply output at 600 kW and approximately 370 Hertz), approximately 300 kW is supplied to the upper coil section and 300 kW is supplied to the lower coil section. This example illustrates the general process condition that as the batch melting proceeds from the cold state to the warm state, more power is provided to the lower coil section than to the upper coil section since the lower coil section surrounds an increasing amount of molten material, which has a lower resistance than the solid material, as the process progresses until the height of the molten material is sufficient to magnetically couple with the field generated by the upper coil section. This condition is opposite to the preferred condition, namely that the solid material should receive more power than the molten material to quicken melting of the entire batch of metal. The solid line in FIG. 4 graphically illustrates the typical efficiency of a batch melting process over the time of the process while the dashed line illustrates a typical 82 percent average efficiency for the process.

Similarly when the primary and secondary coil sections surround a susceptor or an electrically conductive material, such as a billet or metal slab, the arrangement in FIG. 1 and FIG. 2(*a*) through FIG. 2(*c*), with the susceptor or electrically conductive material replacing crucible 110 containing solid metal composition 112, results in a non-controlled temperature pattern along the length of the material due to the fact that the energy delivery pattern is defined by the coil arrangement and the energy consumption pattern is defined by the processes inside a susceptor, or the heat absorption characteristics of the billet material.

Therefore there is the need for selectively inducing heat to a section of a material being inductively heated or melted wherein the inductive heating or melting process utilizes multiple coil sections.

BRIEF SUMMARY OF THE INVENTION

In one aspect, the present invention is an apparatus for, and method of, heating or melting an electrically conductive material. At least one active induction coil and at least one passive induction coil are placed around different sections of the electrically conductive material. Each of the at least one passive induction coil is connected in parallel with a capacitor to form an at least one passive coil circuit. An ac power supply provides power to the at least one active induction coil. Current flowing through the at least one active induction coil generates a first magnetic field around the at least one active induction coil, which magnetically couples with the electrically conductive material substantially surrounded by the at least one active induction coil. The first magnetic field also couples with the at least one passive induction coil, which is not connected to the ac power supply, to cause an induced current to flow in the at least one passive coil circuit. Induced current flow in the at least one passive coil circuit generates a second magnetic field around the at least one passive induction coil, which magnetically couples with the electrically conductive material substantially surrounded by the at least one passive induction coil. Inductive heating power from the power supply can be selectively divided between the load circuits formed by the at least one active induction coil and the at least one passive coil circuit, which are magnetically coupled with the electrically conductive material, by controlling the frequency of the supplied power and selecting the impedances of at least the passive circuits so that the circuits have different resonant frequencies.

Other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings:

FIG. 2(*b*) illustrates a prior art heating and melting process in a warm state wherein approximately half of the electrically conductive material is melted.

FIG. 2(*c*) illustrates a prior art heating and melting process in a hot state wherein substantially all of the electrically conductive material is melted.

FIG. 3(*b*) graphically illustrates power division between upper and lower induction coil sections for the prior art heating and melting warm state shown in FIG. 2(*b*) as a function of the frequency of the applied heating power.

FIG. 3(*c*) graphically illustrates power division between upper and lower induction coil sections for the prior art heating and melting hot state shown in FIG. 2(*c*) as a function of the frequency of the applied heating power.

FIG. 6(*b*) graphically illustrates magnitudes of the currents in the active and passive load coils in the cold state for one example of the electric induction control system of the present invention.

FIG. 6(*c*) graphically illustrates the change in phase shift between currents in the active and passive coils with the change in frequency of the heating power in the cold state for one example of the electric induction control system of the present invention.

FIG. 7(*b*) graphically illustrates magnitudes of currents in the active and passive load coils in the warm state for one example of the electric induction control system of the present invention.

FIG. 7(*c*) graphically illustrates the change in phase shift between currents in the active and passive coils with the change in frequency of the heating power in the warm state for one example of the electric induction control system of the present invention.

FIG. 8(*b*) graphically illustrates magnitudes of currents in the active and passive load coils in the hot state for one example of the electric induction control system of the present invention.

FIG. 8(*c*) graphically illustrates the change in phase shift between currents in the active and passive coils with the change in frequency of the heating power in the hot state for one example of the electric induction melt control system of the present invention.

DETAILED DESCRIPTION OF THE INVENTION

Figure 5:
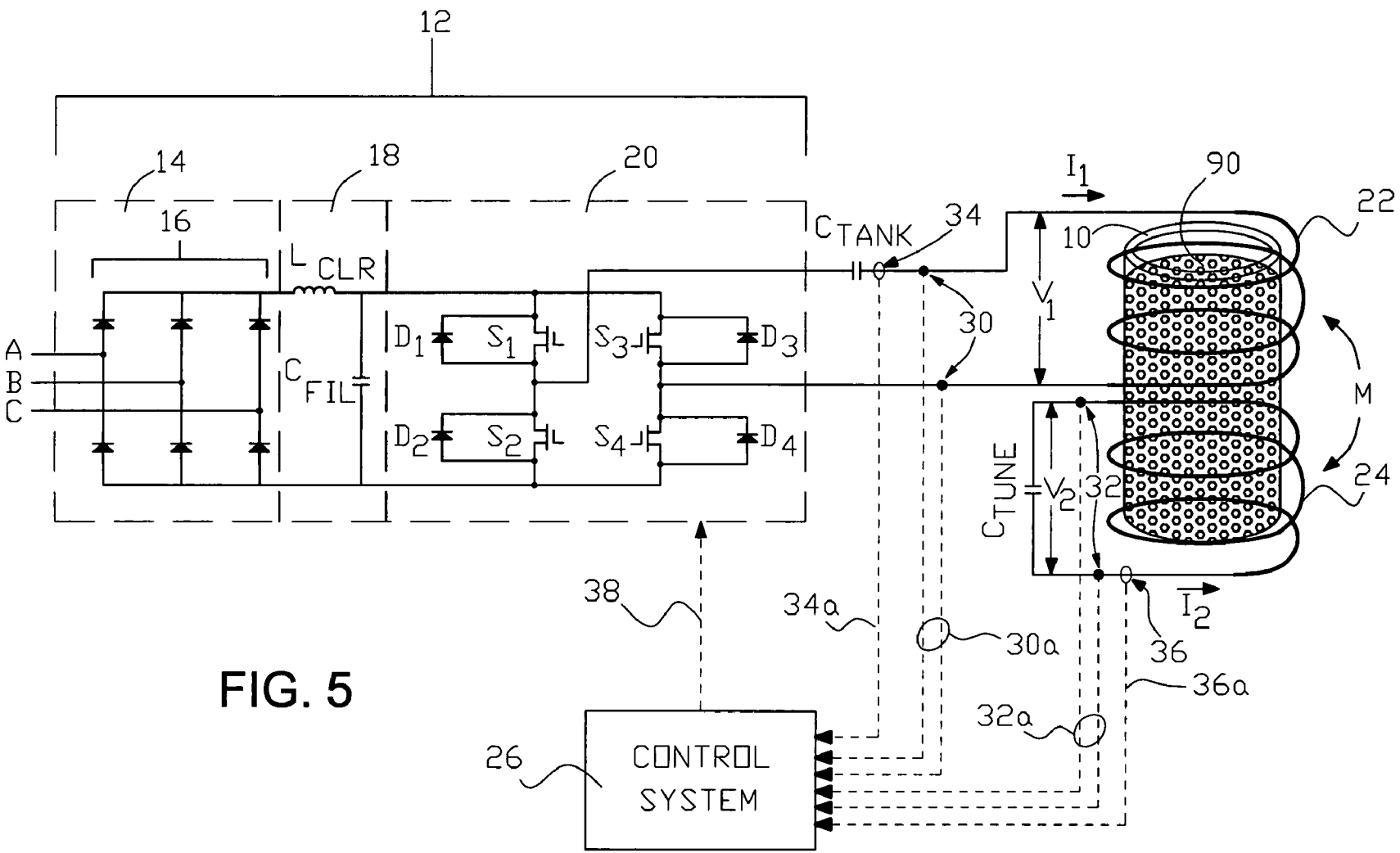
FIG. 5 illustrates in simplified schematic and diagrammatic form one example of the electric induction control system of the present invention.

Referring now to the drawings, wherein like numerals indicate like elements, there is shown in FIG. 5, one example of a simplified electrical diagram of the electric induction control system of the present invention.

U.S. Pat. No. 6,542,535, the entirety of which is incorporated herein by reference, discloses an induction coil comprising an active coil that is connected to the output of an ac power supply, and a passive coil connected with a capacitor to form a closed circuit that is not connected to the power supply. The active and passive coils surround a crucible in which an electrically conductive material is placed. The active and passive coils are arranged so that the active magnetic field generated by current flow in the active coil, which current is supplied from the power supply, magnetically couples with the passive coil, as well as with the material in the crucible.

FIG. 5 illustrates one example of an ac power supply 12 utilized with the electric induction control system of the present invention. Rectifier section 14 comprises a full wave bridge rectifier 16 with ac power input on lines A, B and C. Optional filter section 18 comprises current limiting reactor $L_{CLR}$ and dc filter capacitor $C_{FIL}$. Inverter section 20 comprises four switching devices, $S_1$, $S_2$, $S_3$ and $S_4$, and associated anti-parallel diodes $D_1$, $D_2$, $D_3$ and $D_4$, respectively. Preferably each switching device is a solid state device that can be turned on and off at any time in an ac cycle, such as an insulated gate bipolar transistor (IGBT).

The non-limiting example load circuit comprises active induction coil 22, which is connected to the inverter output of the power supply via load matching (or tank) capacitor $C_{TANK}$, and passive induction coil 24, which is connected in parallel with tuning capacitor $C_{TUNE}$ to form a passive load circuit. Current supplied from the power supply generates a magnetic field around the active induction coil. This field magnetically couples with electrically conductive material 90 in crucible 10 and with the passive induction coil, which induces a current in the passive load circuit. The induced current flowing in the passive induction coil generates a second magnetic field that couples with the electrically conductive material in the crucible. Voltage sensing means 30 and 32 are provided to sense the instantaneous voltage across the active coil and passive coils respectively; and control lines 30*a* and 32*a* transmit the two sensed voltages to control system 26. Current sensing means 34 and 36 are provided to sense the instantaneous current through the active coil and passive coil, respectively; and control lines 34*a* and 36*a* transmit the two sensed currents to control system 26. Control system 26 includes a processor to calculate the instantaneous power in the active load circuit and the passive load circuit from the inputted voltages and currents. The calculated values of power can be compared by the processor with stored data for a desired batch melting process power profile to determine whether the calculated values of power division between the active and passive load circuits are different from the desired batch melting process power profile. If there is a difference, control system 26 will output gate turn on and turn off signals to the switching devices in the inverter via control line 38 so that the output frequency of the inverter is adjusted to achieve the desired power division between the active and passive load circuits.

Figure 6A:
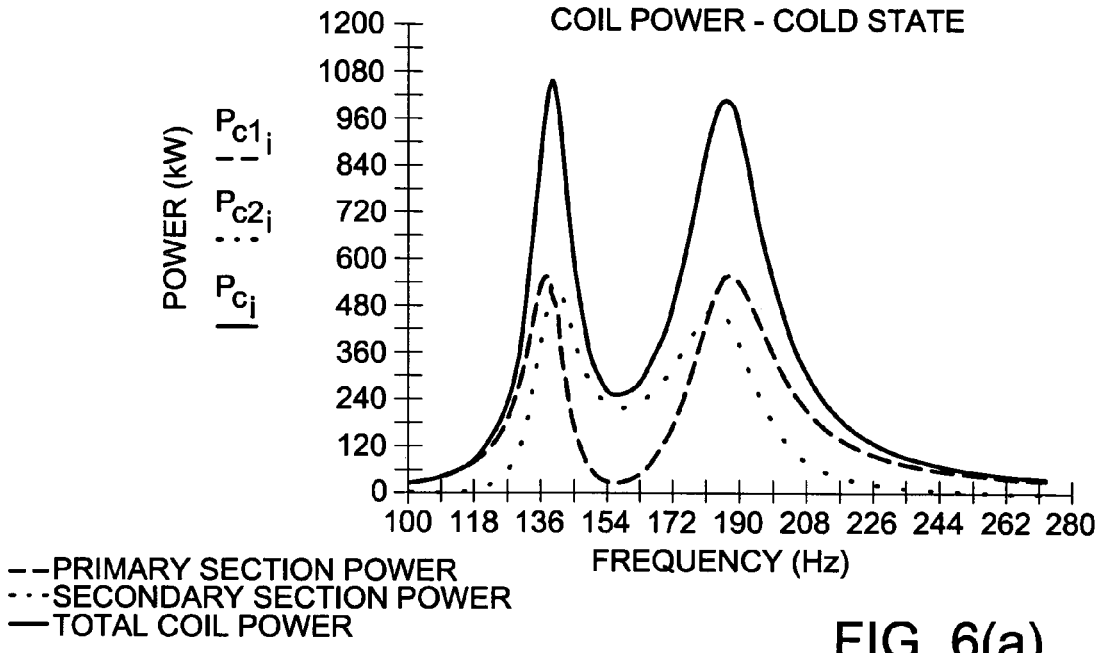
FIG. 6(*a*) graphically illustrates power division between the active induction coil and the passive induction coil in the cold state for one example of the electric induction control system of the present invention as the frequency of the heating power is varied.
Figure 6B:
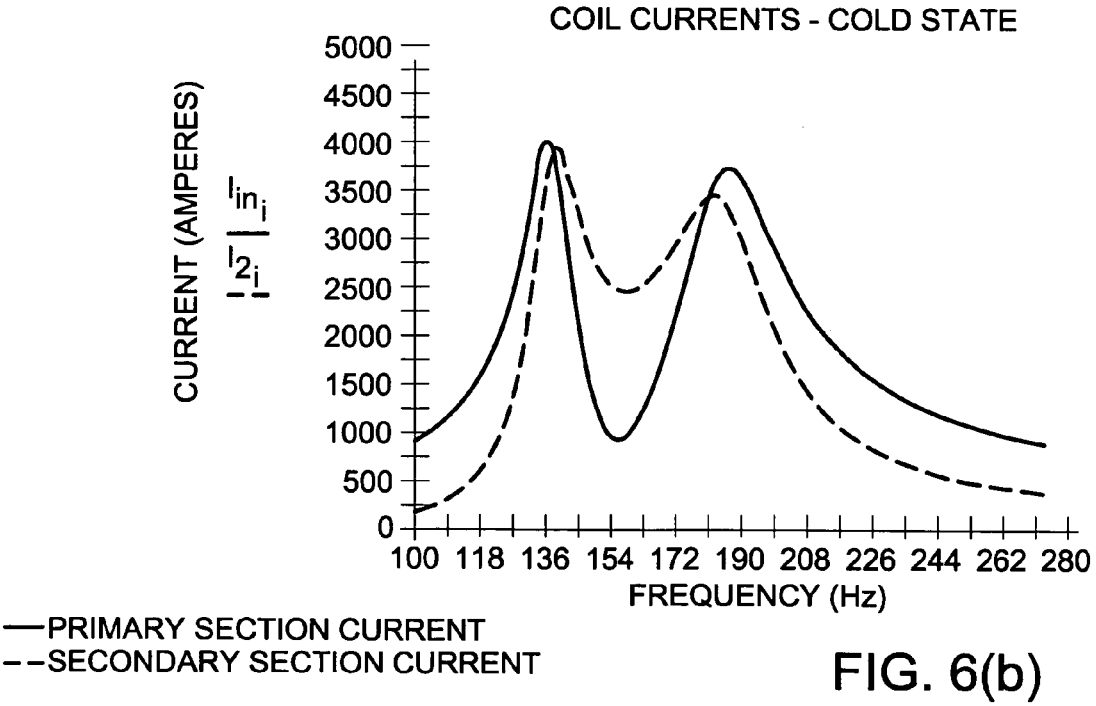
Figure 6C:
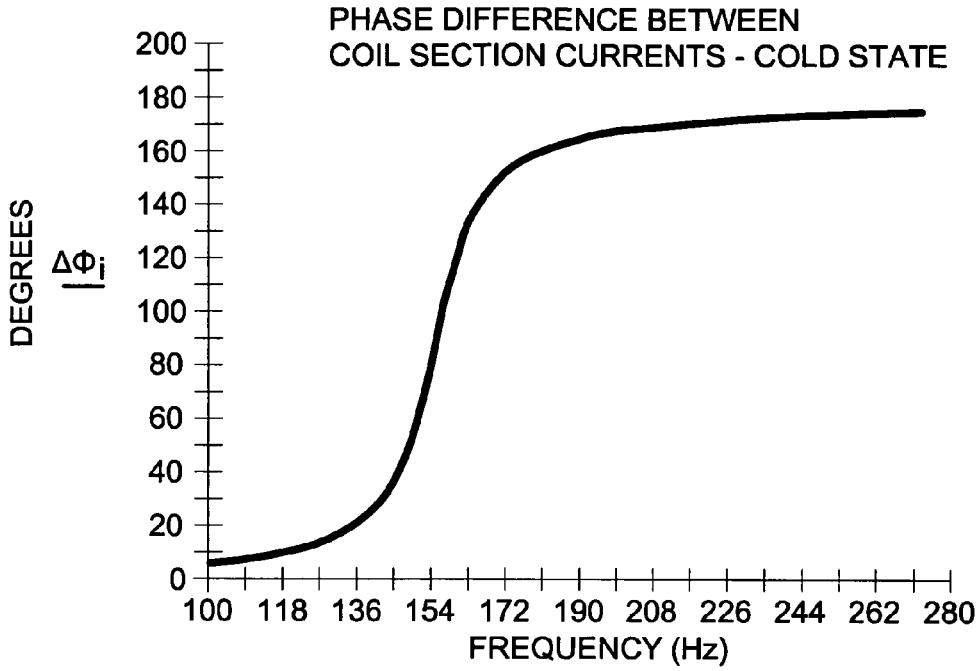

By selecting tank capacitor $C_{TANK}$, tuning capacitor $C_{TUNE}$, and active and passive induction coils of appropriate values, the active load circuit will have a resonant frequency that is different from that of the passive load circuit. FIG. 6(*a*), FIG. 7(*a*) and FIG. 8(*a*) illustrate one example of the power division achieved in active and passive induction coils over a frequency range for one set of circuit values. For example: in the cold state (FIG. 6(*a*) with power supply output at 1,000 kW and approximately 138 Hertz), approximately 500 kW is supplied to the active coil section and 500 kW is supplied to the passive coil section; in the warm state (FIG. 7(*a*) with power supply output at 1,000 kW and approximately 136 Hertz), approximately 825 kW is supplied to the active coil section and 175 kW is supplied to the passive coil section; and in the hot state (FIG. 8(*a*) with power supply output at 1,000 kW and approximately 134 Hertz), approximately 500 kW is supplied to the active coil section and approximately 500 kW is supplied to the passive coil section. Unlike the prior art, in the intermediate states between the cold and hot state, more power can be directed to the upper (active) coil, which surrounds substantially solid material in the crucible for the approximately first half of the batch melting process in this example, than to the lower (passive) coil, which surrounds an increasing level of molten material for the approximately first half of the batch melting process in this example. This condition is exemplified by the power division in the warm state wherein the induction heating control system of the present example directs most of the power to the upper coil to melt the substantially solid material surround by the upper coil.

The stored data for a desired batch melting process for a particular circuit and crucible arrangement may be determined from the physical and electrical characteristics of the particular arrangement. Power and current characteristics versus frequency for the active and passive load circuits in a particular arrangement may also be determined from the physical and electrical characteristics of a particular arrangement.

In alternative examples of the invention different parameters and methods may be used to measure power in the active and passive load circuits as known in the art. The processor in control system 26 may be a microprocessor or any other suitable processing device. In other examples of the invention different numbers of active and passive induction coils may be used; the coils may also be configured differently around the crucible. For example active and passive coils may be overlapped, interspaced or counter-wound to each other to achieve a controlled application of induced power to selected regions of the electrically conductive material.

Figure 7A:
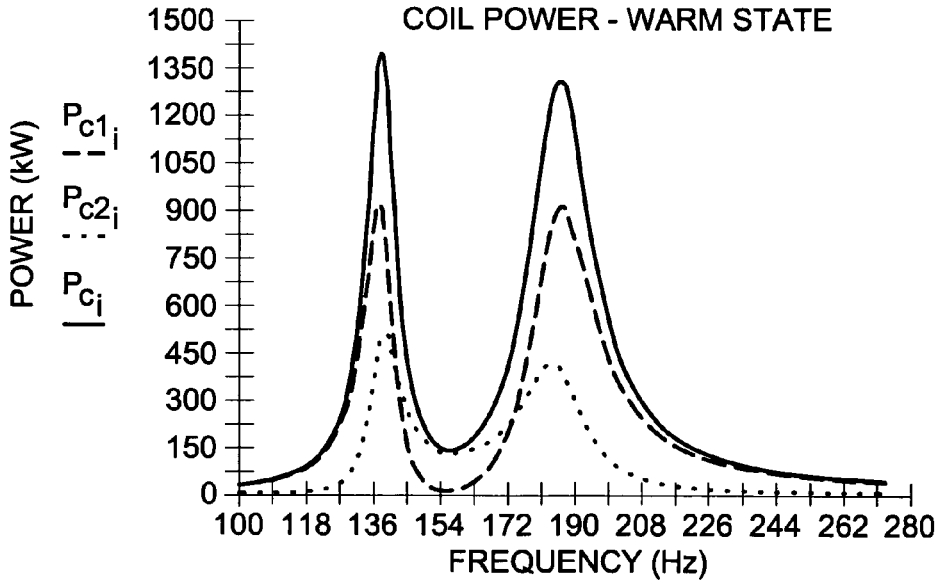
FIG. 7(*a*) graphically illustrates power division between the active induction coil and the passive induction coil in the warm state for one example of the electric induction control system of the present invention as the frequency of the heating power is varied.
Figure 7B:
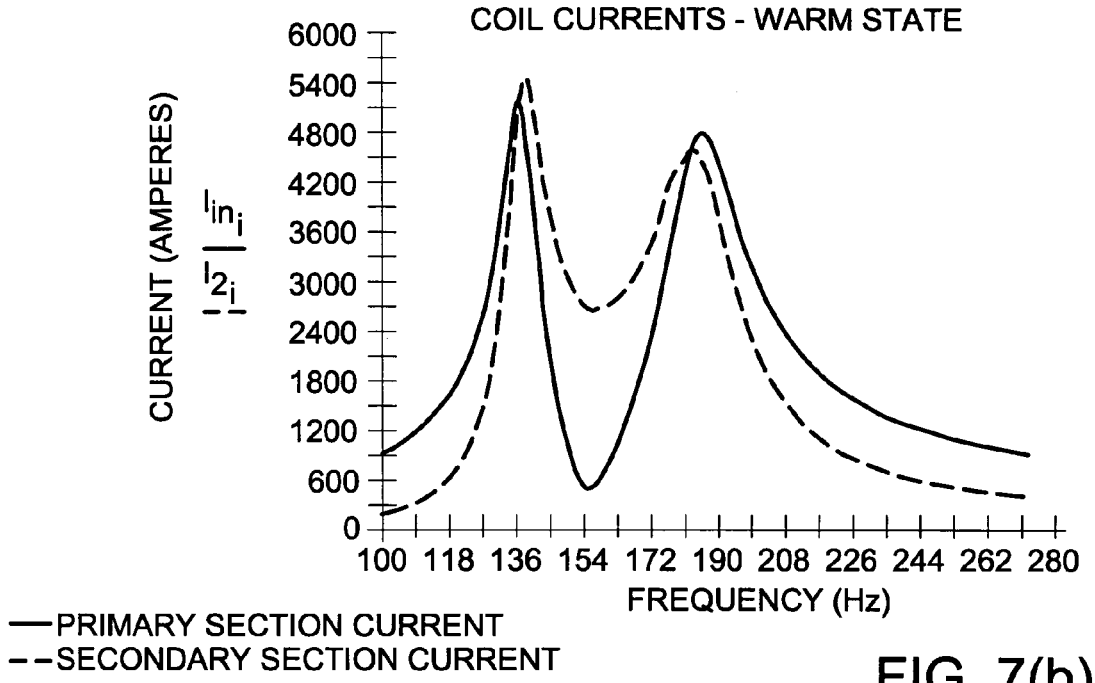
Figure 7C:
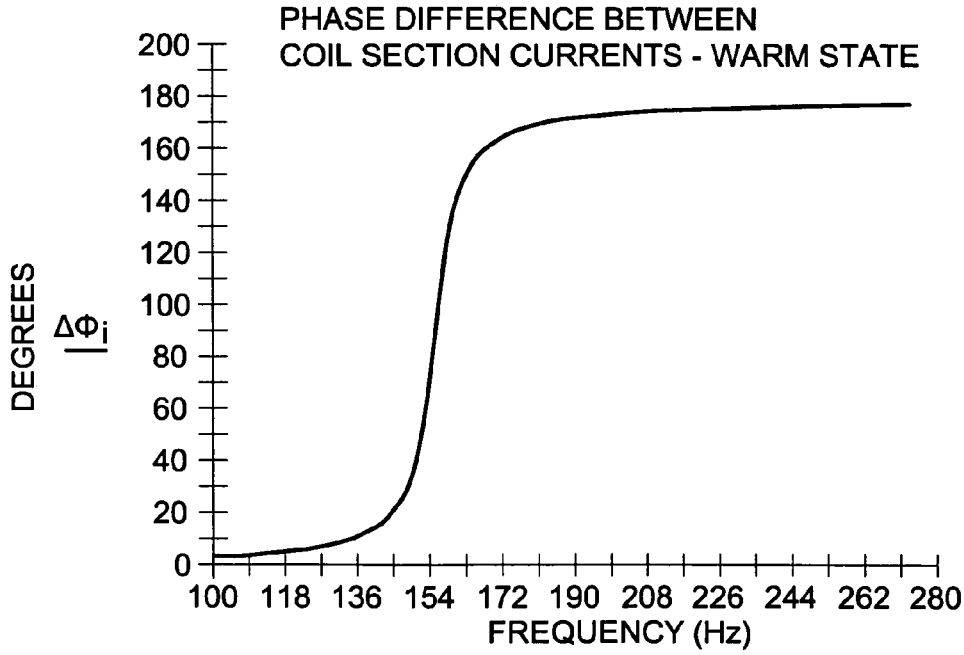
Figure 8A:
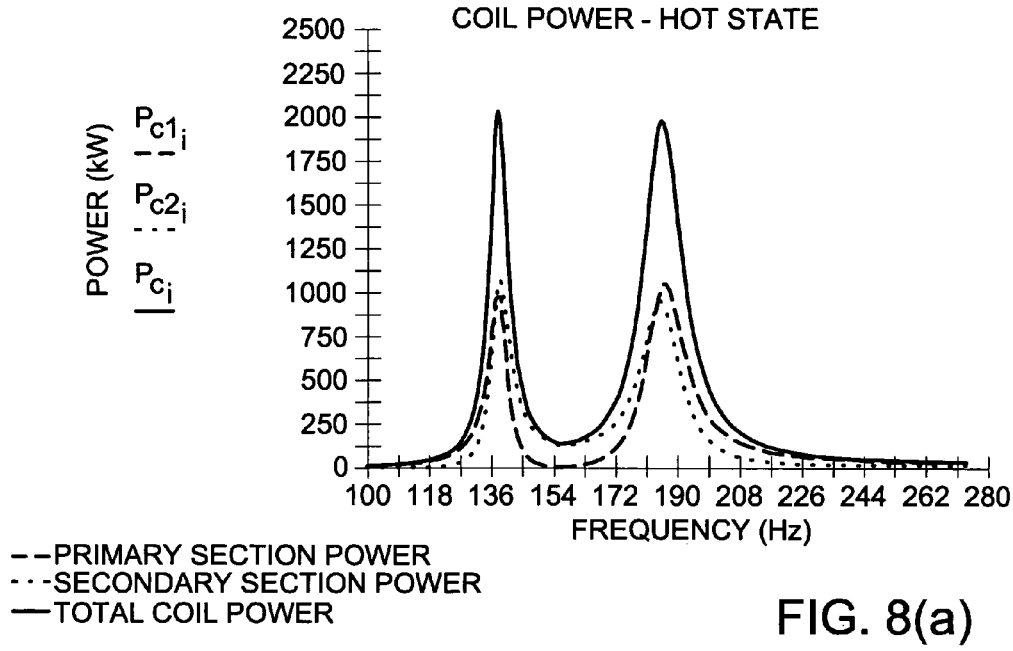
FIG. 8(*a*) graphically illustrates power division between the active induction coil and the passive induction coil in the hot state for one example of the electric induction control system of the present invention as the frequency of the heating power is varied.
Figure 8B:
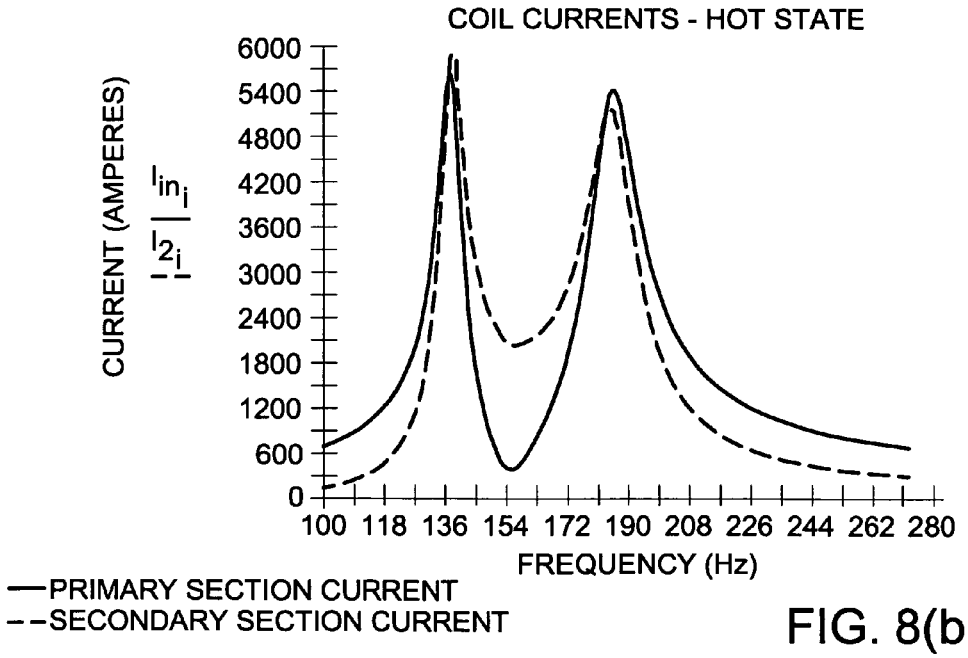
Figure 8C:
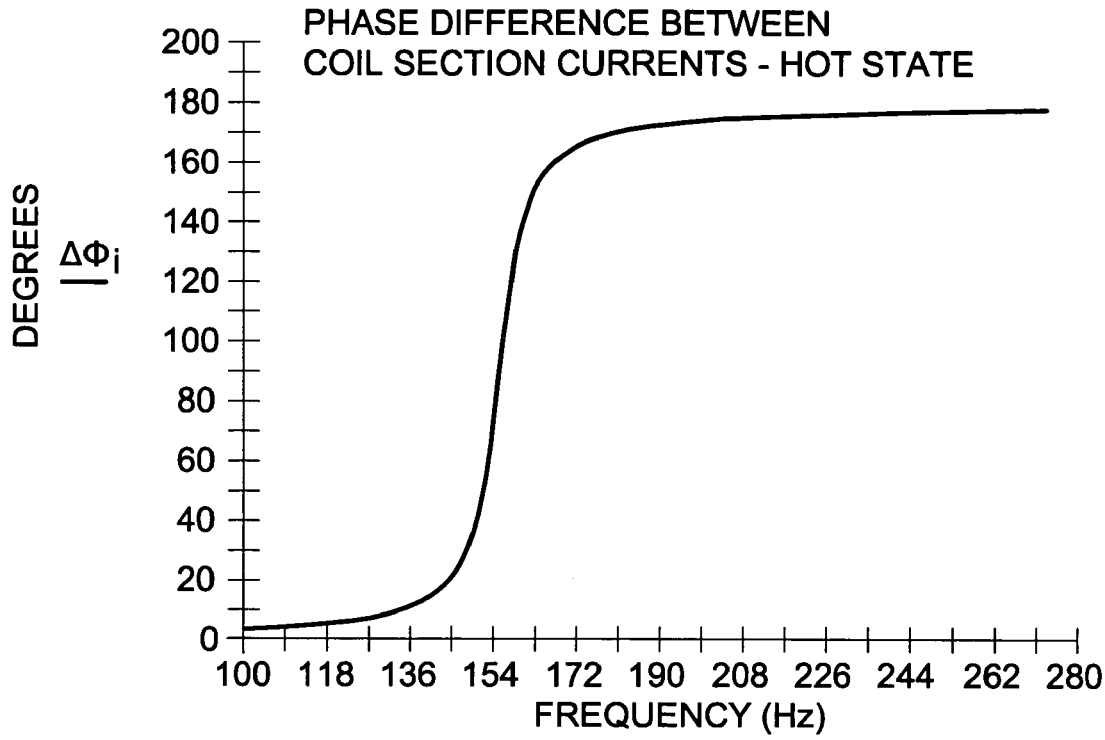

FIG. 6(*b*), FIG. 7(*b*) and FIG. 8(*b*) graphically illustrate current magnitudes for the currents in the active and passive load coils for the cold, warm and hot states, respectively, that are associated with the example of the invention represented by the power magnitudes in FIG. 6(*a*), FIG. 7(*a*) and FIG. 8(*a*) respectively.

FIG. 6(*c*), FIG. 7(*c*) and FIG. 8(*c*) graphically illustrate the difference in phase angle between the currents in the active and passive load coils for the cold, warm and hot states, respectively, that are associated with the example of the invention represented by the current magnitudes in FIG. 6(*b*), FIG. 7(*b*) and FIG. 8(*b*) respectively. Preferably, but not by way of limitation, the phase shift between the active and passive coil currents is kept sufficiently low, at least lower than 30 degrees, to minimize the difference in phase shift so that significant magnetic field cancellation does not occur between the fields generated around the active and passive coils.

Figure 1:
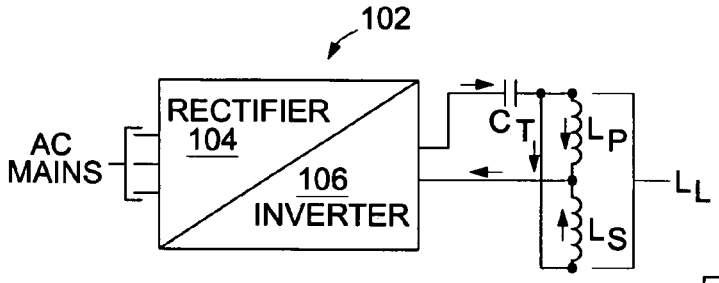
FIG. 1 PRIOR ART
FIG. 1 is a prior art circuit arrangement for inductively heating and melting an electrically conductive material.
Figure 2A:
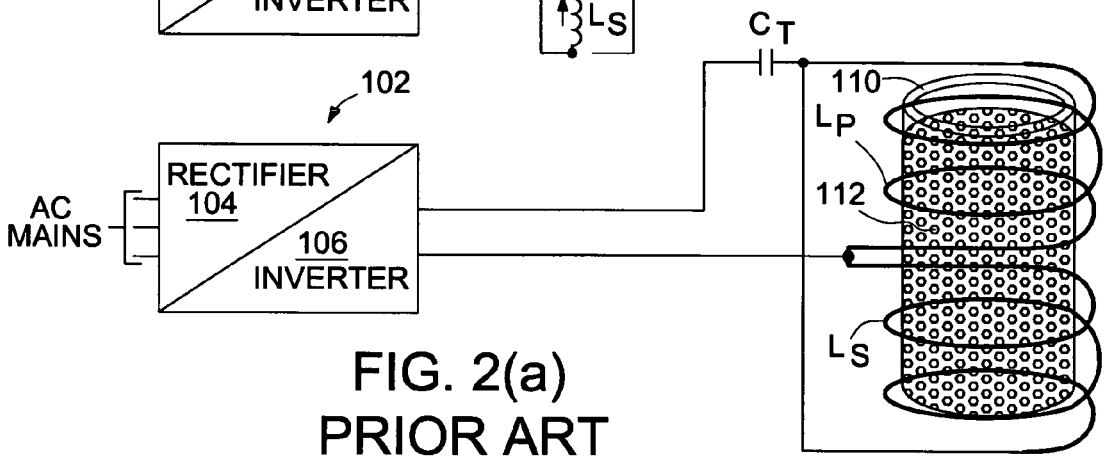
FIG. 2(a) PRIOR ART
FIG. 2(*a*) illustrates a prior art heating and melting process in a cold state wherein substantially none of the electrically conductive material is melted.
Figure 2B:
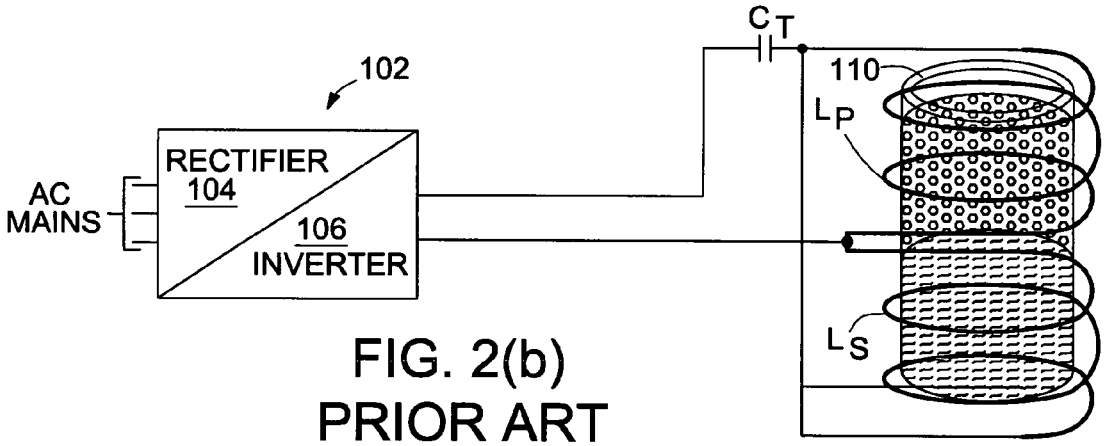
FIG. 2(b) PRIOR ART
Figure 2C:
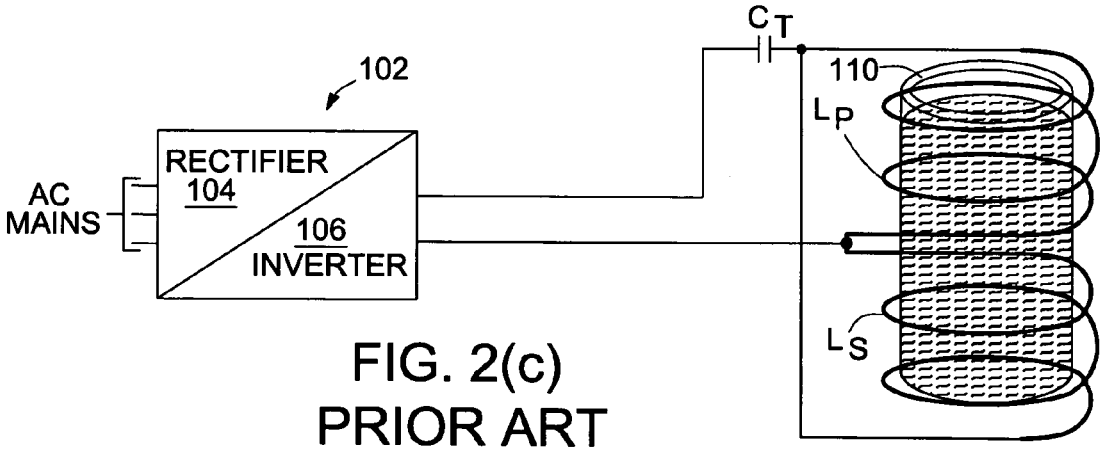
FIG. 2(c) PRIOR ART
Figure 3A:
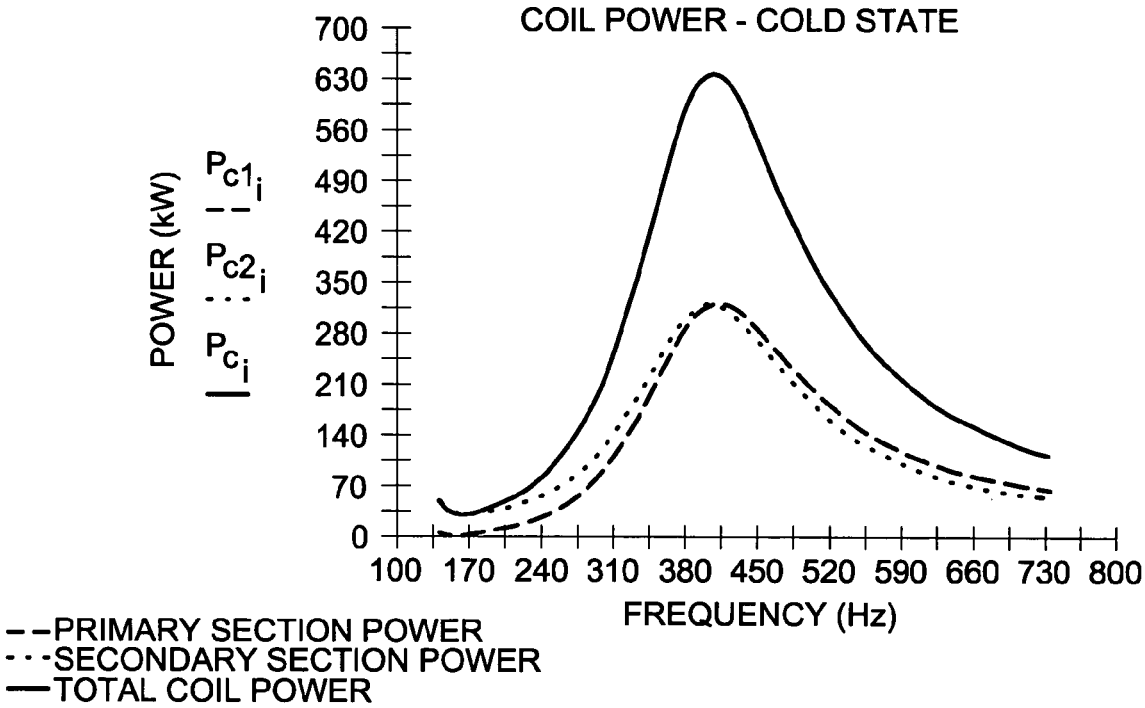
FIG. 3(a) PRIOR ART
FIG. 3(*a*) graphically illustrates power division between upper and lower induction coil sections for the prior art heating and melting cold state shown in FIG. 2(*a*) as a function of the frequency of the applied heating power.
Figure 3B:
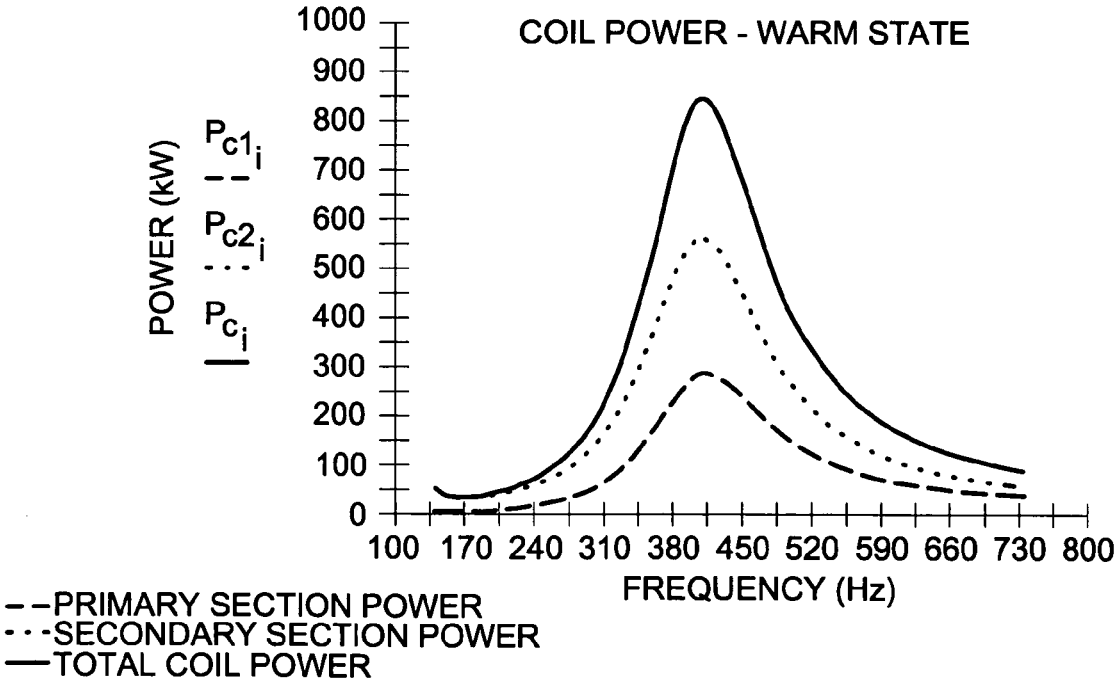
FIG. 3(b) PRIOR ART
Figure 3C:
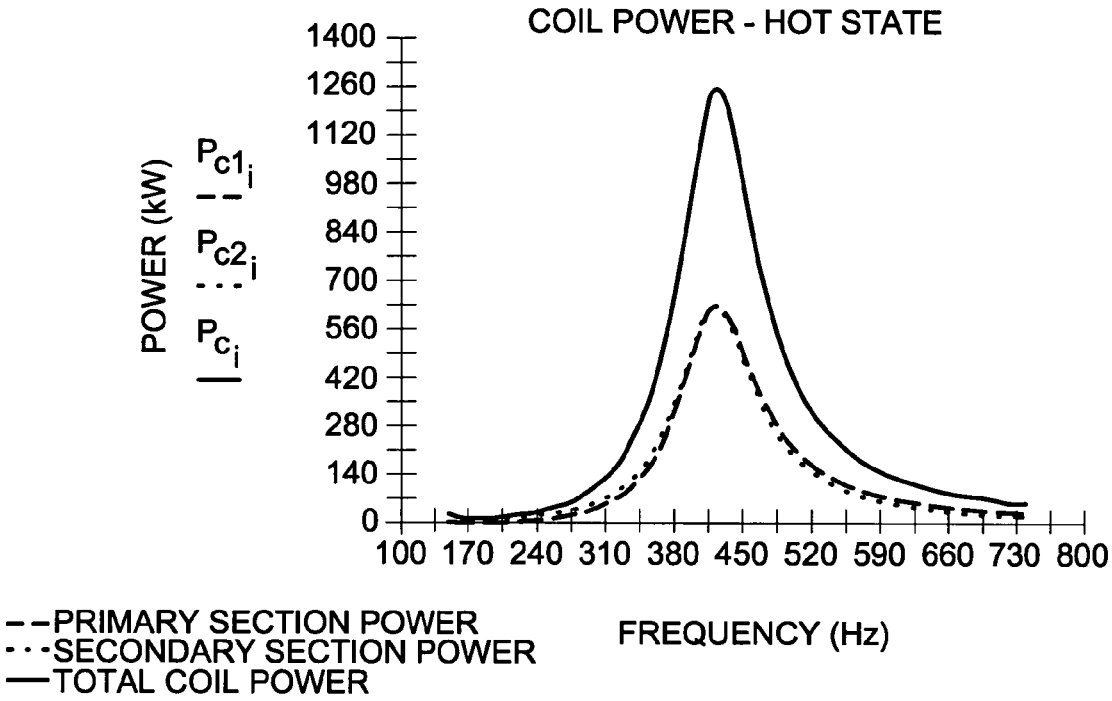
FIG. 3(c) PRIOR ART
Figure 4:
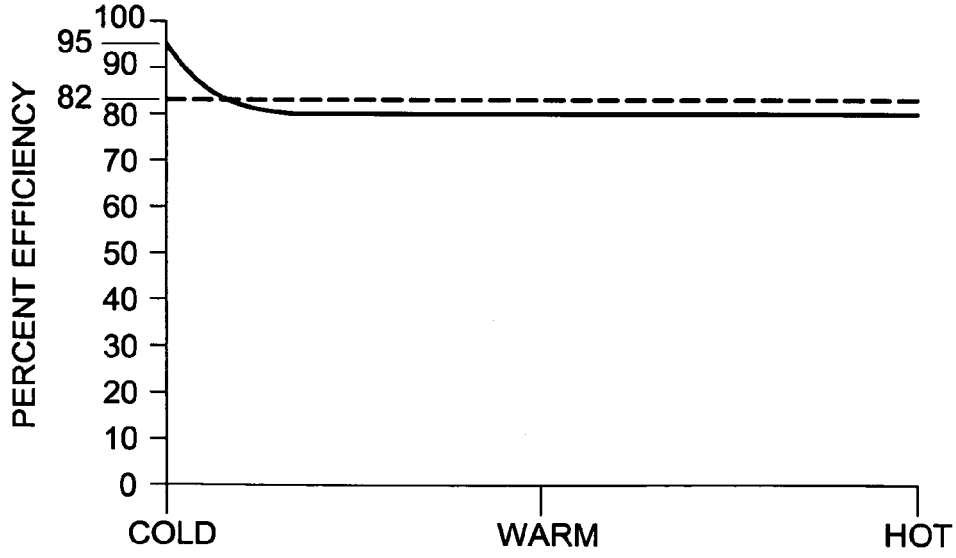
FIG. 4 PRIOR ART
FIG. 4 graphically illustrates the typical efficiency of the prior art heating and melting process.
Figure 9:
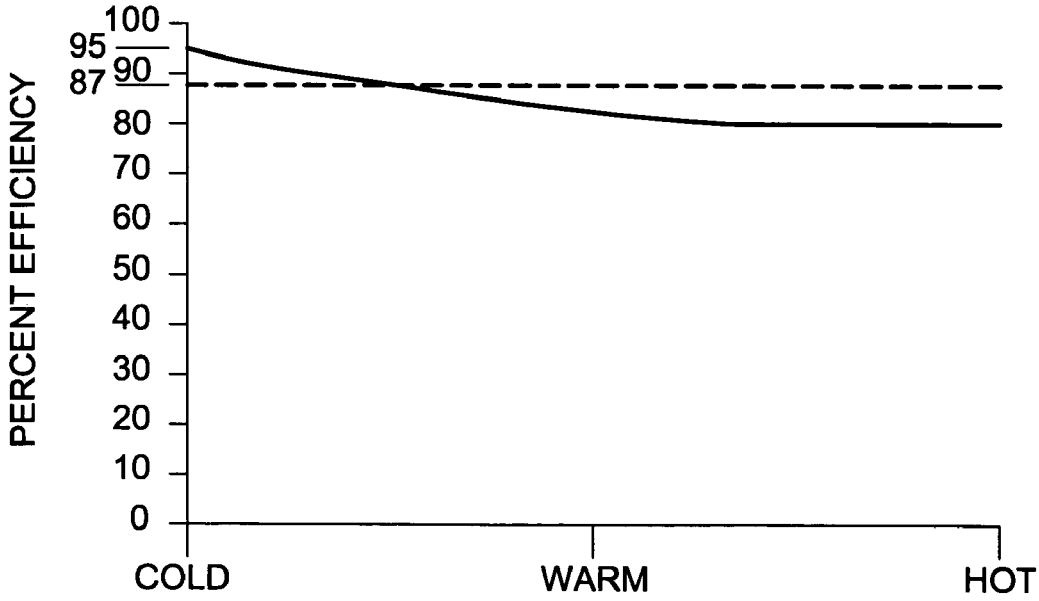
FIG. 9 graphically illustrates the typical efficiency achieved with one example of the electric induction control system of the present invention.

FIG. 9 graphically illustrates the typical efficiency of a batch melting process over the time of the process utilizing the induction melt process control system of the present invention. Comparing the solid line curve in FIG. 9 with the efficiency curve in FIG. 4, with the control system of the present invention, the efficiency of a batch melting process over the time of the process can be maintained at a higher value for a longer period of time, in comparison with the prior art process. Consequently average efficiency for the process, as illustrated by the dashed line in FIG. 9 will be higher (87 percent in this example), and the process can be accomplished in a shorter period of time.

Figure 10A:
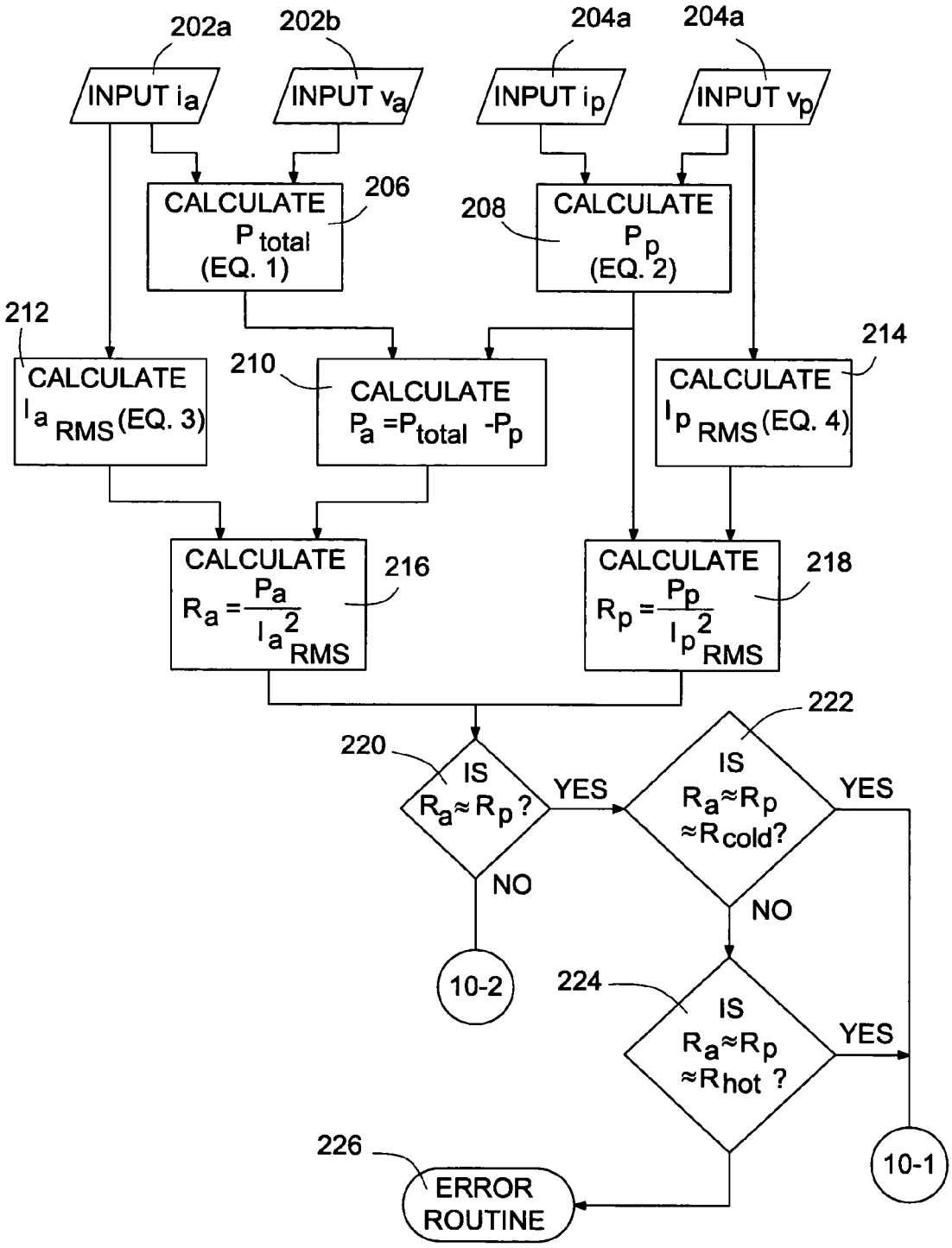
FIG. 10(*a*) and FIG. 10(*b*) is a flow chart illustrating one example of the electric induction control system of the present invention.
Figure 10B:
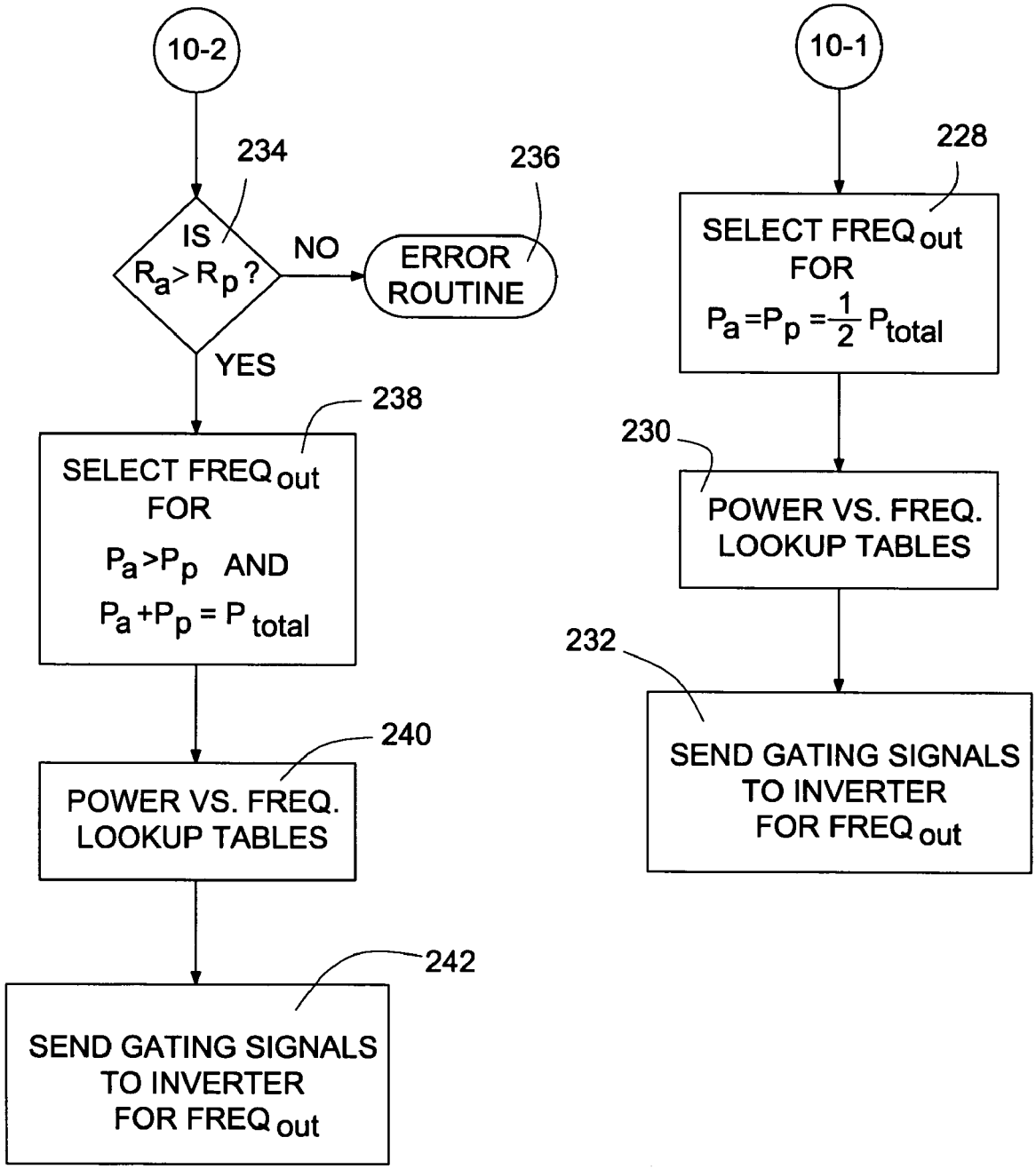

By way of example and not limitation, the electric induction melt control system of the present invention may be practiced by implementing the simplified control algorithm illustrated in the flow diagram presented in FIG. 10(*a*) and FIG. 10(*b*) with suitable computer hardware and software programming of the routines shown in the flow diagram. In FIG. 10(*a*), during a batch melting process, routines 202*a* and 204*a* periodically receive inputs from suitable current sensors that sense the instantaneous total load current, $i_a$, (both active and passive load circuits) and passive load current, $i_p$, respectively. Similarly routines 202*b* and 204*b* periodically receive inputs from suitable voltage sensors that sense the instantaneous load voltage across the active induction coil, $v_a$, and the instantaneous load voltage across the passive induction coil, $v_p$, respectively.

Routine 206 calculates total load power, $P_{total}$, from Equation 1:

$$P_{total} = \frac{1}{T}\int^{T} i_a \cdot v_a \, dt$$

where T is the inverse of the output frequency of the inverter.

Routine 208 calculates passive load power, $P_p$, from Equation 2:

$$P_p = \frac{1}{T}\int^{T} i_p \cdot v_p \, dt.$$

Routine 210 calculates active load circuit power, $P_a$, by subtracting passive load power, $P_p$, from total load power, $P_{total}$.

Routine 212 calculates RMS active load circuit current, $I_{aRMS}$, from Equation 3:

$$I_{aRMS} = \sqrt{\frac{1}{T}\int^{T} i_a^2 \, dt}.$$

Similarly routine 214 calculates RMS passive load circuit current, $I_{pRMS}$, from Equation 4:

$$I_{pRMS} = \sqrt{\frac{1}{T}\int^{T} i_p^2 \, dt}.$$

Active load circuit resistance, $R_a$, is calculated by dividing active load circuit power, $P_a$, by the square of the RMS active load circuit current, $(I_{aRMS})^2$, in routine 216.

Similarly in routine 218 passive load circuit resistance, $R_p$, is calculated by dividing passive load circuit power, $P_p$. by the square of the RMS passive load circuit current, $(I_{pRMS})^2$.

Routine 220 determines if active load circuit resistance, $R_a$, is approximately equal to passive load circuit resistance, $R_p$. A preset tolerance band of resistance values can be included in routine 220 to establish the approximation band. If $R_a$ is approximately equal to $R_p$, routine 222 checks to see if these two values are approximately equal to the total load circuit resistance in the cold state, $R_{cold}$, when substantially all of the material in the crucible is in the solid state. For a given load circuit and crucible configuration, $R_{cold}$, may be determined by one skilled in the art by conducting preliminary tests and using the test value in routine 222. Further multiple values of $R_{cold}$may be determined based upon the volume and type of the material in the crucible, with means for an operator to select the appropriate value for a particular batch melting process. If the approximately equal values of $R_a$ and $R_p$ are not approximately equal to the value of $R_{cold}$, routine 224 checks to see if these two values are approximately equal to the total load circuit resistance in the hot state, $R_{hot}$, when substantially all of the material in the crucible is in the molten state. For a given load circuit and crucible configuration, $R_{hot}$, may be determined by one skilled in the art by conducting preliminary tests and using the test value in routine 224. Further multiple values of $R_{hot}$ may be determined based upon the volume and type of the material in the crucible, with means for an operator to select the appropriate value for a particular batch melting process. If the approximately equal values of $R_a$ and $R_p$ are not approximately equal to the value of $R_{hot}$, error routine 226 is executed to evaluate why $R_a$ and $R_p$ are approximately equal to each other, but not approximately equal to $R_{cold}$ or $R_{hot}$.

If routine 222 or routine 224 determines that the approximately equal values of $R_a$ and $R_p$ are approximately equal to $R_{cold}$ or $R_{hot}$, as illustrated in FIG. 10(*b*), routine 228 uses power vs. frequency (POWER VS. FRQ.) cold or hot lookup tables 230, respectively, to select an output frequency, $FREQ_{out}$, for the inverter that will make the active load circuit power, $P_a$, substantially equal to the passive load circuit power, $P_p$. Routine 232 outputs appropriate signals to the gate control circuits for the switching devices in the inverter so that the inverter output frequency is substantially equal to $FREQ_{out}$.

If routine 220 in FIG. 10(*a*) determines that R*a* is not approximately equal to $R_p$, routine 234 in FIG. 10(*b*) determines if $R_a$ is greater than $R_p$; if not, error routine 236 is executed to evaluate the abnormal state wherein $R_a$ is less than $R_p$.

If routine 234 in FIG. 10(*b*) determines that R*a* is greater than $R_p$, then routine 238 uses power vs. frequency lookup table 240, to select an output frequency, $FREQ_{out}$, for the inverter that will make the active load circuit power, $P_a$, greater than the passive load circuit power, $P_p$. while the sum of the active and passive load circuit power remains equal to $P_{total}$. Routine 242 outputs appropriate signals to the gate control circuits for the switching devices in the inverter so that the inverter output frequency is substantially equal to $FREQ_{out}$.

Generally, but not by way of limitation, $P_{total}$ will remain constant throughout the batch melting process. Values in power vs. frequency lookup tables 230 and 240 can be predetermined by one skilled in the art by conducting preliminary tests and using the test values in lookup tables 230 and 240. Adaptive controls means can be used in some examples of the invention so that values in power vs. frequency lookup tables 230 and 240 are refined during sequential batch melting processes, based upon melt performance maximization routines, for use in a subsequent batch melting process.

Figure 11B:
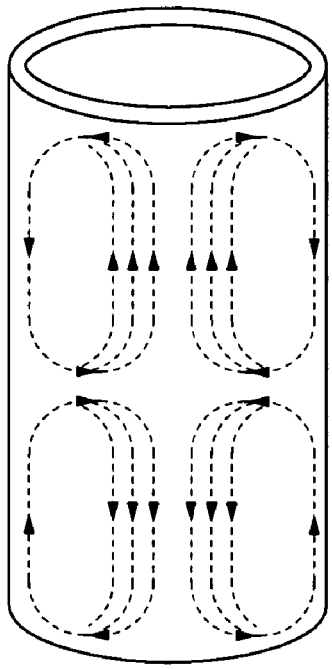
FIG. 11(*a*) and FIG. 11(*b*) illustrate electromagnetic flow patterns for molten material in a crucible with the electric induction control system of the present invention when the electrical phases between the active and passive load circuit currents are approximately 90 electrical degrees and less than 20 electrical degrees, respectively.
Figure 11A:
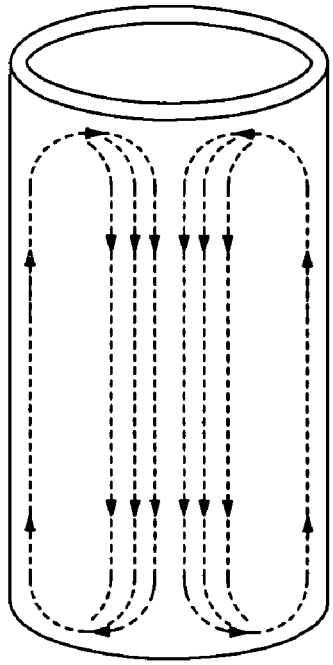

Optionally stirring of the melt in the hot state may be achieved by selecting an inverter output frequency at which the phase shift between the active and passive coil currents is approximately 90 electrical degrees. This mode of operation forces melt circulation from the bottom of the crucible to the top, as illustrated in FIG. 11(*a*), and is generally preferred to the typical circulation in which the melt in the top half of the crucible has a circulation pattern different from that in the bottom half of the crucible as illustrated in FIG. 11(*b*). As can be seen from FIG. 6(*c*), FIG. 7(*c*) and FIG. 8(*c*), the operating frequencies for a 90 degrees phase shift result in relatively low heating power (FIG. 6(*a*), FIG. 7(*a*) and FIG. 8(*a*)). However the stirring mode is generally used after an entire batch of material is melted, and can be used intermittently if additional heating power is required to keep the batch melt at a desired temperature.

Figure 12:
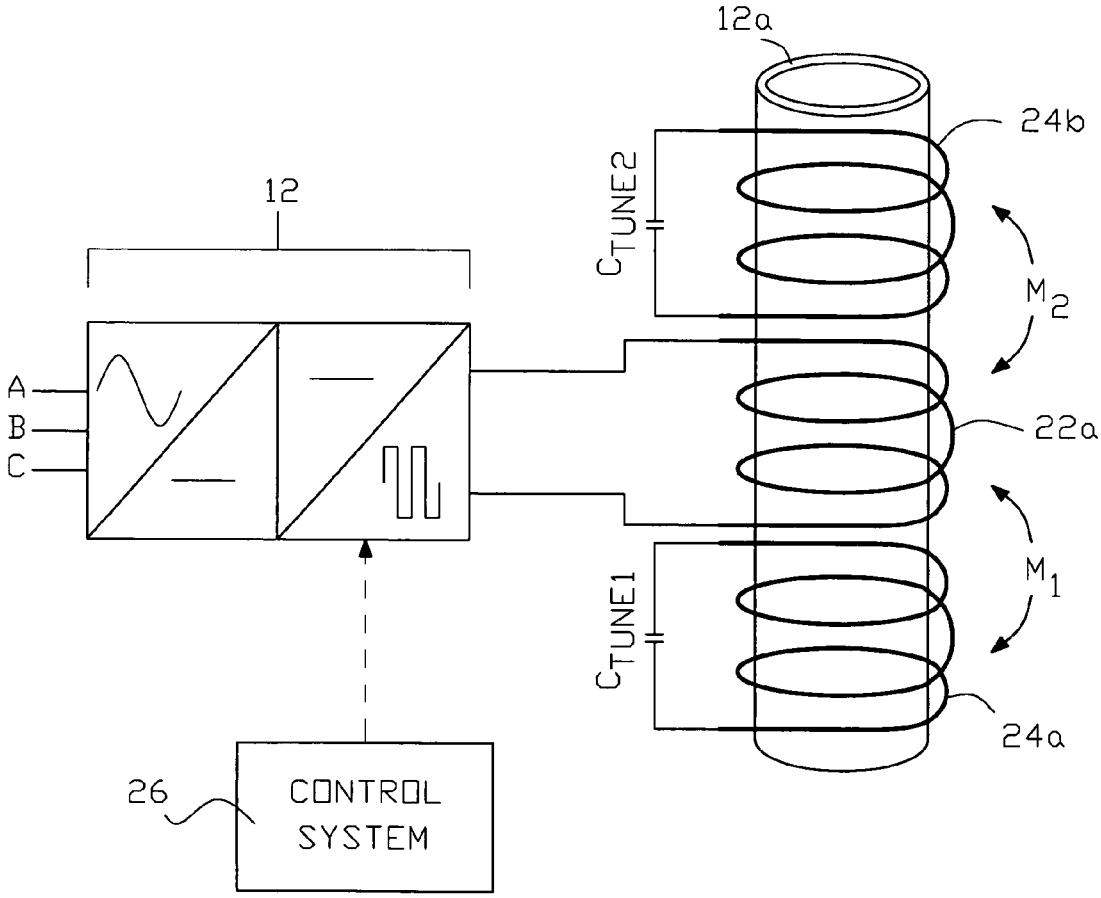
FIG. 12 illustrates in simplified schematic and diagrammatic form another example of the electric induction control system of the present invention.

FIG. 12 illustrates another example of the electric induction control system of the present invention. In this example ac power supply 12 provides power to active induction coil 22*a* (active coil section) to form the active circuit. Passive induction coils 24*a* and 24*b* (passive coil sections) are connected in parallel with capacitive elements $C_{TUNE1}$ and $C_{TUNE2}$, respectively, to form two separate passive circuits. Passive induction coils 24*a* and 24*b* are magnetically coupled (diagrammatically illustrated by arrows with associated $M_1$ and $M_2$ in the figure) with the primary magnetic field created by the flow of current in the active circuit, which in turn, generates currents in the passive circuits that generate secondary magnetic fields around each of the passive induction coils. Electrically conductive workpiece 12*a* can be located within the active and passive coils. The primary magnetic field will electromagnetically couple substantially with the middle zone of the workpiece in this particular non-limiting arrangement of the active and passive coils to inductively heat the workpiece in that region. The secondary magnetic field for bottom passive induction coil 24*a* will substantially couple with the bottom zone of the workpiece to heat that region; and the secondary magnetic field for top passive induction coil 24*b* will substantially couple with the top zone of the workpiece to heat that region. By suitably selecting impedances for the active and passive circuits, for example by selected capacitance values for the capacitive elements and/or inductance values for the induction coils, two or more of the coil circuits can be tuned to a different resonant frequency so that when the output frequency of the power supply is changed, those coil circuits will operate at different resonant frequencies for maximum applied induced power to the region of the material surrounded by the coil operating at resonant frequency.

Figure 13:
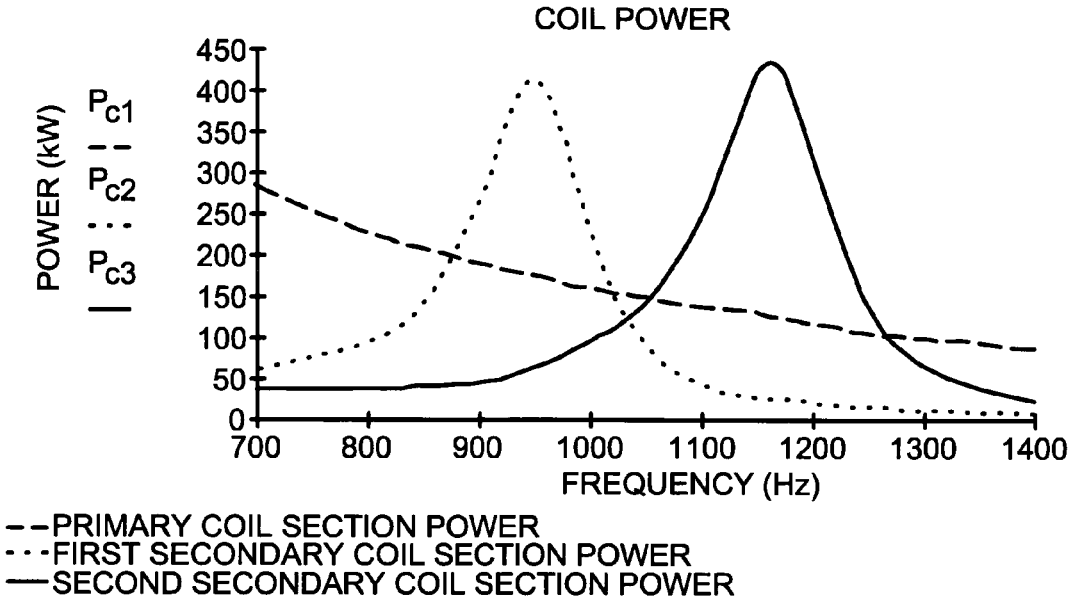
FIG. 13 illustrates power division between active induction coil and passive induction coils for an example of the present invention illustrated in FIG. 12 where the output frequency of the power supplied is changed to vary the applied induction power to different sections of an electrically conductive material.

FIG. 13 graphically illustrates the change in magnitude of applied induced power to each of the three zones of the electrically conductive material when the output frequency of the power supply is changed for one example of the invention. Referring to FIG. 12 and FIG. 13, in this non-limiting example of the invention, power ($P_{c1}$) in the active circuit (labeled PRIMARY COIL SECTION POWER in FIG. 13) decreases as frequency is increased; power ($P_{c2}$) in the bottom passive circuit (labeled FIRST SECONDARY COIL SECTION POWER in FIG. 13) peaks at a resonant frequency of about 950 Hertz; and power ($P_{c3}$) in the top passive circuit (labeled SECOND SECONDARY COIL SECTION POWER in FIG. 13) peaks at a resonant frequency of about 1,160 Hertz. For this particular example, the active coil circuit does not have a resonant frequency over the operating range; in other examples of the invention, the active coil circuit may also have a resonant frequency. It is not necessary to operate at resonant frequency; establishment of discrete resonant frequencies allow operating over a frequency range while controlling the amount of power distributed to each zone. The invention also comprises examples wherein two or more active circuits may be provided and each of those active circuits may be coupled with one or more passive circuits.

Figure 14:
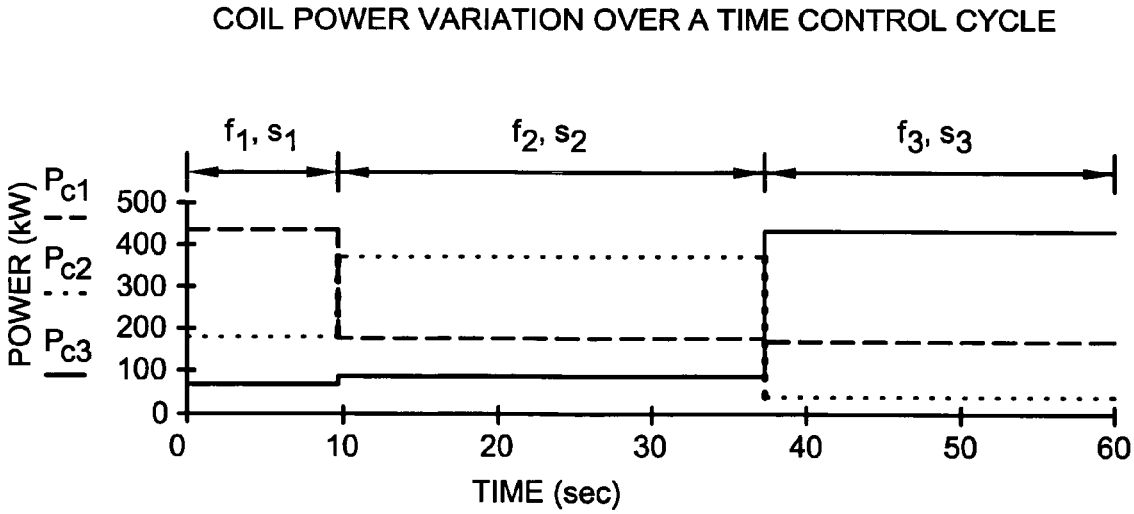
FIG. 14 illustrates one example of the time distribution of applied induction power to different sections of an electrically conductive material for an example of the present invention illustrated in FIG. 12.

FIG. 14 graphically illustrates another example of the present invention as applied to the circuit shown in FIG. 12. Induced power may be applied to each of the three zones of the electrically conductive material at selected different frequencies for different time periods making up a control cycle, which is 60 seconds in this example, to achieve a particular heating pattern of the material. Power is supplied sequentially from the power supply over the control cycle as follows: power at frequency $f_1$ for approximately 10 seconds ($s_1$); power at frequency $f_2$ for approximately 27 seconds ($s_2$); and power at frequency $f_3$ for approximately 23 seconds ($s_3$). With this control scheme, although instantaneous power may be quite different from zone to zone as shown in FIG. 14, time average power values over a control cycle for each zone can be made substantially the same by suitable selection of resonant frequencies for the passive circuits.

The term "electrically conductive workpiece" includes a susceptor, which can be a conductive susceptor formed, for example, from a graphite composition, which is inductively heated. The induced heated is then transferred by conduction or radiation to a workpiece moving in the vicinity of the susceptor, or a process being performed in the vicinity of the susceptor. For example a workpiece may be moved through the interior of a susceptor so that it absorbs heat radiated or conducted from the inductively heated susceptor. In this case the workpiece may be a non-electrically conductive material, such as a plastic. Alternatively a process may be performed within the susceptor, for example a gas flow through the susceptor may absorb the heat radiated or conducted from the inductively heated susceptor. Heat absorption by the workpiece or process along the length of the susceptor may be non-uniform and the induction control system of the present invention may be used to direct induced power to selected regions of the susceptor as required to account for the non-uniformity. Generally whether the process is the heating of a workpiece moving near a susceptor, or other heat absorbing process is performed neared the susceptor, all these processes are referred to as "heat absorbing processes."

Zone temperature data for the workpiece may be inputted to control system 26 as the heating process is performed. For example, for a susceptor, temperature sensors, such as thermocouples, may be located in each zone of the susceptor to provide zone temperature signals to the control system. The control system can process the received temperature data and regulate output frequency of the power supply as required for a particular process. In some examples of the invention output power level of the power supply may be kept constant; in other examples of the invention, power supply output power level (or voltage) can be changed by suitable means, such as pulse width modulation, along with the frequency. For example if the overall temperature of the electrically conductive material is too low, the output power level from the power supply may be increased by increasing the voltage pulse width.

It is noted that the foregoing examples have been provided merely for the purpose of explanation and are in no way to be construed as limiting of the present invention. While the invention has been described with reference to various embodiments, it is understood that the words which have been used herein are words of description and illustration, rather than words of limitations. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa. Circuit elements without values indicated in the drawings can be selected in accordance with known circuit design procedures. Those skilled in the art, having the benefit of the teachings of this specification, may effect numerous modifications thereto and changes may be made without departing from the scope and spirit of the invention in its aspects.

The invention claimed is:

1. Apparatus for electric induction heating or melting of an electrically conductive material, the apparatus comprising:

a susceptor associated with a heat absorbing process that absorbs heat by conduction or radiation from the susceptor;

an active induction coil surrounding a first section of the susceptor, the active induction coil connected to an ac power supply to form an active circuit and to generate a first magnetic field, the first magnetic field magnetically coupling with the susceptor substantially in a first section of the susceptor;

a pair of passive induction coils, each of the pair of passive induction coils located adjacent to opposing ends of the active induction coil and respectively surrounding second and third sections of the susceptor, each of the pair of passive induction coils exclusively connected in parallel with at least one capacitance element to form a passive circuit, the first magnetic field magnetically coupling with each of the pair of passive induction coils to generate a second and third current in each of the pair of passive circuits, the second and third currents generating second and third magnetic fields respectively, the second and third magnetic fields magnetically coupling with the susceptor substantially in the second and third sections of the susceptor respectively, the impedance of each of the pair of passive circuits selected so that each of the passive circuits has a different resonant frequency different from any resonant frequency of the active circuit; and a control system for selectively changing the output frequency of the ac power supply to change the amount of induced power in the active circuit and each of the pair of passive circuits.

2. The apparatus of claim 1 further comprising a control system for selectively changing the output power level of the ac power supply.

3. A method of controlling the electric induction heating or melting of a susceptor surrounded in a first region by an active induction coil forming an active circuit, and surrounded in second and third regions located respectively above and below the first region by a first and second passive induction coil respectively, each of the first and second passive induction coils forming an exclusive first and second passive circuit with a first and second capacitive element respectively, each of the first and second passive circuits having a resonant frequency different from any resonant frequency of the active circuit, the method comprising the steps of:

supplying a first ac current to the active circuit from a power supply to generate a first magnetic field around the active induction coil, the first magnetic field magnetically coupling with the susceptor substantially in the first region, the first magnetic field magnetically coupling with the first and second passive induction coils to induce a second and third ac current in the first and second passive circuits respectively, to generate second and third magnetic fields around the first and second passive induction coils respectively, the second and third magnetic fields magnetically coupling with the susceptor substantially in the second and third regions;

adjusting the frequency of the first ac current to change the distribution of applied induced power among the active induction coil and the first and second passive induction coils; and performing a heat absorbing process in the vicinity of the susceptor so that the process absorbs heat induced in the susceptor by radiation or conduction.

4. The method of claim 3 further comprising the step of adjusting the output power level of the power supply.

5. The method of claim 3 further comprising the step of changing the output frequency of the power supply for multiple time periods over a control cycle.

6. Apparatus for electric induction heating of a susceptor, the apparatus comprising:

an active induction coil surrounding a first section of the susceptor;

a pair of passive induction coils, each one of the pair of passive induction coils located adjacent to opposing ends of the active induction coil and respectively surrounding second and third sections of the susceptor, each of the pair of passive induction coils exclusively connected in parallel with at least one capacitance element to form a first and second passive circuit;

an ac power supply having its output connected to the active induction coil to form an active circuit, whereby ac current supplied from the output of the ac power supply and flowing through the active induction coil generates a first magnetic field that magnetically couples with the susceptor in the first section of the susceptor and each one of the pair of passive induction coils to generate a second and third current in each respective first and second passive circuits, the second and third currents respectively generating a second and third magnetic field that magnetically couples with the susceptor in the second and third sections of the susceptor respectively, the impedance of the first and second passive circuits selected so that each of the passive circuits has a resonant frequency different from any resonant frequency of the active circuit; and a control system for selectively changing the output frequency of the ac power supply to change the amount of power in the active circuit and each of the pair of passive circuits.

7. The apparatus of claim 6 further comprising a control system for selectively changing the output power level of the ac power supply.

* * * * *